US011107627B2

(12) United States Patent
Peng et al.

(10) Patent No.: US 11,107,627 B2
(45) Date of Patent: Aug. 31, 2021

(54) METHOD AND AN APPARATUS FOR MANUFACTURING AN R-FE-B SINTERED MAGNET

(71) Applicant: Yantai Shougang Magnetic Materials, Inc., Yantai (CN)

(72) Inventors: Zhongjie Peng, Yantai (CN); Xiaotong Liu, Yantai (CN)

(73) Assignee: YANTAI SHOUGANG MAGNETIC MATERIALS INC., Yantai (CN)

( * ) Notice: Subject to any disclaimer, the term of this patent is extended or adjusted under 35 U.S.C. 154(b) by 48 days.

(21) Appl. No.: 16/236,926

(22) Filed: Dec. 31, 2018

(65) Prior Publication Data

US 2019/0206618 A1 Jul. 4, 2019

(30) Foreign Application Priority Data

Dec. 30, 2017 (CN) ..... 201711491300.4

(51) Int. Cl.

| | |
|---|---|
| ***H01F 41/02*** | (2006.01) |
| ***H01F 1/057*** | (2006.01) |
| ***C23C 4/134*** | (2016.01) |
| ***C23C 4/02*** | (2006.01) |
| ***C23C 4/08*** | (2016.01) |
| ***C23C 4/18*** | (2006.01) |

(52) U.S. Cl.

CPC ..... *H01F 41/0293* (2013.01); *C23C 4/02* (2013.01); *C23C 4/08* (2013.01); *C23C 4/134* (2016.01); *C23C 4/18* (2013.01); *H01F 1/057* (2013.01); *H01F 1/0577* (2013.01); *H01F 41/0253* (2013.01)

(58) Field of Classification Search

CPC . C23C 4/134; H01F 41/0293; H01F 41/0253; H01F 1/057; H01F 1/053; H01F 1/0536; H01F 1/0577

USPC ..... 427/446

See application file for complete search history.

(56) References Cited

U.S. PATENT DOCUMENTS 4,634,611 A * 1/1987 Browning ..... C23C 4/129 239/132.3

2004/0229078 A1* 11/2004 Maeda ..... C23C 4/11 428/650

(Continued)

FOREIGN PATENT DOCUMENTS

EP 2808877 * 3/2014

*Primary Examiner* — Tabassom Tadayyon Eslami

(74) *Attorney, Agent, or Firm* — William H. Honaker; Dickinson Wright PLLC

(57) ABSTRACT

A method of manufacturing a plurality of R—Fe—B sintered magnets using a plasma flame apparatus and a furnace. The method includes a first step of providing a sintered magnet block. Then, the sintered magnet block is machined to form machined magnets. The method continues with a step of cleaning surfaces of the machined magnets to form cleaned magnets. The method then proceeds with depositing a plurality of spherical droplets of a heavy rare earth powder selected from at least one of Dy or Tb on the surfaces of the cleaned magnets, to produce a plurality of magnets including a uniform film of Dy or Tb. Then, the magnets including the uniform film are sintered to diffuse the uniform film into the magnets through grain boundary phases of the magnets to produce the R—Fe—B sintered magnets. A plasma flame apparatus is also disclosed herein.

10 Claims, 2 Drawing Sheets

(56) References Cited

U.S. PATENT DOCUMENTS

| | | | | |
|---|---|---|---|---|
| 2009/0246398 | A1* | 10/2009 | Kurahashi | C23C 4/12 427/456 |
| 2013/0271248 | A1* | 10/2013 | Nagata | B22F 3/26 335/302 |
| 2017/0018342 | A1* | 1/2017 | Fukagawa | C22C 38/30 |
| 2018/0122571 | A1* | 5/2018 | Takagi | H01F 41/0253 |

* cited by examiner

METHOD AND AN APPARATUS FOR MANUFACTURING AN R-FE-B SINTERED MAGNET

CROSS REFERENCE TO RELATED APPLICATION

This application claims priority to Chinese application serial number CN201711491300.4 filed on Dec. 30, 2017, the entire disclosure of which is incorporated herein by reference in its entirety.

BACKGROUND OF THE INVENTION

1. Field of the Invention

The present invention generally relates to a method and an apparatus of manufacturing an R—Fe—B sintered magnet.

2. Description of the Prior Art

With the development of the alternative energy industry and technology advancements, e.g. wind power, air conditioning and refrigerator compressors, hybrid, and fuel cell electric vehicles worldwide, there is a requirement for R—Fe—B rare earth sintered magnet to have a higher performance. In particular, in order to meet the demands of increasing the coercive force of the R—Fe—B rare earth sintered magnets, it is known to introduce heavy rare earth elements such as terbium (Tb) or dysprosium (Dy) in a raw material or metal alloy smelting process. Although Tb or Dy in the main phase can improve the coercivity of the R—Fe—B rare earth sintered magnets, the presence of Tb or Dy also causes a large reduction in the remanence of the R—Fe—B rare earth sintered magnets. Because the world's rare earth resources are relatively scarce, the price of Dy or Tb has increased substantially. Thus, reducing production costs and the amount of heavy rare earth elements while ensuring high magnetic properties of the Nd—Fe—B have become an important development direction of the Nd—Fe—B industry.

Based on an in-depth study of low-heavy rare earth elements and high-coercivity sintered Nd—Fe—B materials, the grain boundary diffusion process has been proposed and developed. This method mainly diffuses Dy or Tb into the sintered Nd—Fe—B magnet along the grain boundary phase, and preferentially distributes it to the edge of the main phase to improve the anisotropy of an uneven region of the main phase thereby significantly increase the coercive force without reducing the remanence. Since the grain boundary diffusion process improves the coercive force of the magnet without reducing the remanence and magnetic energy product of the magnet and the amount of use of heavy rare earth is small, it has great practical significance. Therefore, in the past decade or so, a significant amount of research work has been carried out for the grain boundary diffusion process, and many researches has been done on a stacking method of the Dy or Tb on the surface of the magnet.

Chinese patent CN 102768898A discloses a method wherein Dy or Tb oxide, fluoride or oxyfluoride is made into a slurry and applied to the surface of a sintered magnet. Then, the a sintered magnet including the slurry is heat-treated to diffuse Tb or Dy into the interior of the sintered magnet along the grain boundary phase to increase the coercive force of the sintered magnet. However, a large amount of powder containing Dy or Tb adheres to the surface of the magnet treated by this method. Even after cleaning, a small amount remains on the surface of the magnet which results in waste of materials. In addition, the thickness of the coating slurry is not uniform. Therefore, the coercive force is not uniform throughout the magnet after heat treatment, and the magnet can be easily demagnetized locally.

Chinese patent CN 102969110A discloses an evaporation diffusion method wherein the sintered magnet is placed in a treatment chamber, and at least one evaporation source, e.g. Tb or Dy, is also placed in the treatment chamber. The evaporation source is then heated to a predetermined temperature to vaporize the evaporation source, and the vaporized evaporation source is deposited on the surface of the magnet and diffused into the grain boundary phase of the sintered magnet. With this method, the sintered magnet cannot be in directly contact with the evaporating source, and the sintered magnet needs to be placed on a grid or other support. When the vaporized evaporation source reacts with the sintered magnet, the grain boundary phase is in a molten state. Under this condition, due to gravity, the sintered magnet becomes distorted and a secondary shaping treatment is required. Further, this method also causes the vaporized evaporation source, e.g. Dy or Tb vapor, to be partially solidified in the treatment chamber wall. Accordingly, this method is not only wastes heavy metals but reduces production efficiency.

Chinese Patent No. CN101707107A also discloses a method wherein a sintered magnet is buried in a rare earth element Dy or Tb oxide, fluoride or oxyfluoride and heat-treated in a vacuum sintering furnace. The surface of the magnet treated by this method will also adhere to a large amount of powder containing Dy or Tb oxide, fluoride or oxyfluoride. Even after cleaning, a small portion remains on the surface, resulting in waste of materials. Moreover, in this method, the solid particle powder of Dy or Tb is in direct contact with the sintered magnet, which causes an uneven diffusion of Dy or Tb into the sintered magnet. Therefore, the coercive force is not evenly improved, and the magnet can be easily demagnetized.

Chinese patent CN201310209231B discloses a method of spraying metal Dy or metal Tb on the surface of a sintered magnet by a thermal spraying method. The powder ionization effect of this method is poor. In addition, large particles of Dy or Tb are sprayed on the surface of the sintered magnet which provides a poor appearance and affects the performance uniformity of the sintered magnet after diffusion. Further, this method can only achieve large-area spraying. Local spraying of the sintered magnet cannot be realized. Accordingly, it is not effective to the improvement of the utilization rate of rare earth metals. Heavy rare earth metals such as Dy or Tb can be easily oxidized. Therefore, and it is difficult to make a heavy rare earth metal into a linear metal wire as a spray material. Even if it can be achieved, the processing cost very high; and the cathode material in the spray gun is a consumable material, which reduces the stability of the equipment.

SUMMARY OF THE INVENTION

The present invention overcomes the deficiencies mentioned above and provides a method of manufacturing a plurality of R—Fe—B sintered magnets having improved diffusion of the heavy rare earth elements into the sintered magnet. The present invention also provides a R—Fe—B sintered magnets having improved the coercive force which is uniformly distributed in the sintered magnet. The present invention further provides a high utilization of heavy rare earth element such as Dy or Tb during the diffusion process. The plasma flame apparatus in accordance with the present invention has a simple design which improves the operational stability of the equipment.

It is one aspect of the present invention to provide a method of manufacturing a plurality of R—Fe—B sintered magnets using a plasma flame apparatus and a furnace. The plasma flame apparatus has a plasma torch connected to a chamber and including a reaction gas, a carrier gas, and a cooling gas connected to the plasma torch. The method includes a first step of providing a sintered magnet block having a composition of $R_1$-T-B-$M_1$ including a $R_2$—$Fe_{14}$—B main phase wherein $R_1$ is present between 25 wt. % and 40 wt. % based on the total weight of the composition, $M_1$ is present between 0 wt. % and 4 wt. % based on the total weight of the composition, B is present between 0.8 wt. % and 1.5 wt. %, and the balance is T. $R_1$ is at least one rare earth element including Sc and Y. T is a transition selected from a group consisting of Fe or Co, B is Boron. $M_1$ is at least one element selected from a group consisting of Ti, Hf, V, Nb, Ta, Mn, Ni, Cu, Ag, Zn, Zr, Al, Ga, In, C, Si, Ge, Sn, Pb, N, P, Bi, S, Sb, or O. The method continues with a step of machining the sintered magnet block to form a plurality of machined magnets. After machining, the method continues with a step of cleaning surfaces of the machined magnets to form a plurality of cleaned magnets. Next, the method proceeds with depositing a plurality of spherical droplets of a heavy rare earth powder selected from at least one of Dy or Tb on the surfaces of the cleaned magnets, in the chamber of the plasma flame apparatus and under an inert atmosphere of Argon, and in a predetermined pattern to produce a plurality of magnets including a uniform film of Dy or Tb. Then, the method continues with sintering the magnets including the uniform film in the furnace under a negative atmosphere or an inert atmosphere and at a sintering temperature and sintering pressure to diffuse the uniform film into the magnets through grain boundary phases of the magnets to produce the R—Fe—B sintered magnets.

It is another aspect of the present invention to provide a plasma flame apparatus for depositing a film of heavy rare earth elements on a plurality of magnets. The plasma flame apparatus includes a housing having a bottom wall and a pair of sidewalls. The sidewalls extend outwardly from the bottom wall to define a chamber between the sidewalls and the bottom wall. A top wall is attached to the sidewalls to close the chamber. A hopper is connected to the top wall and is in communication with the chamber for receiving a powder of a heavy rare earth element selected from a group consisting of Dy or Tb. A plasma torch is disposed in communication with the hopper and the chamber for spheroidizing the powder for deposition on the plurality of magnets. A conveyor is disposed in the chamber and movably attached to the housing located directly below the plasma torch for receiving and transporting the plurality of magnets to the plasma torch to allow the plasma torch to deposit the film of heavy rare earth elements on one surface of the plurality of magnets. A flip member is disposed adjacent to the conveyor for inverting the magnets and allow the plasma torch to deposit the film of heavy rare earth elements on another surface of the plurality of magnets. A vacuum system, disposed adjacent to one of the sidewalls, is in communication with the chamber for drawing air from the chamber to provide an negative atmosphere when depositing the film of heavy rare earth elements on one surface of the plurality of magnets. A gas supply system including a reaction gas source, a carrier gas source, and a cooling gas source, is in communication with the hopper and the channel of the plasma torch for transporting the powder of the heavy rare earth element from the hopper to the plasma torch for atomizing the powder. An Argon circulation system is disposed in communication with the chamber for circulating and purifying Argon in the chamber to provide an inert atmosphere when depositing the film of heavy rare earth elements on one surface of the plurality of magnets.

BRIEF DESCRIPTION OF THE DRAWINGS

Other advantages of the present invention will be readily appreciated, as the same becomes better understood by reference to the following detailed description when considered in connection with the accompanying drawings wherein.

DESCRIPTION OF THE ENABLING EMBODIMENT

Figure 1:
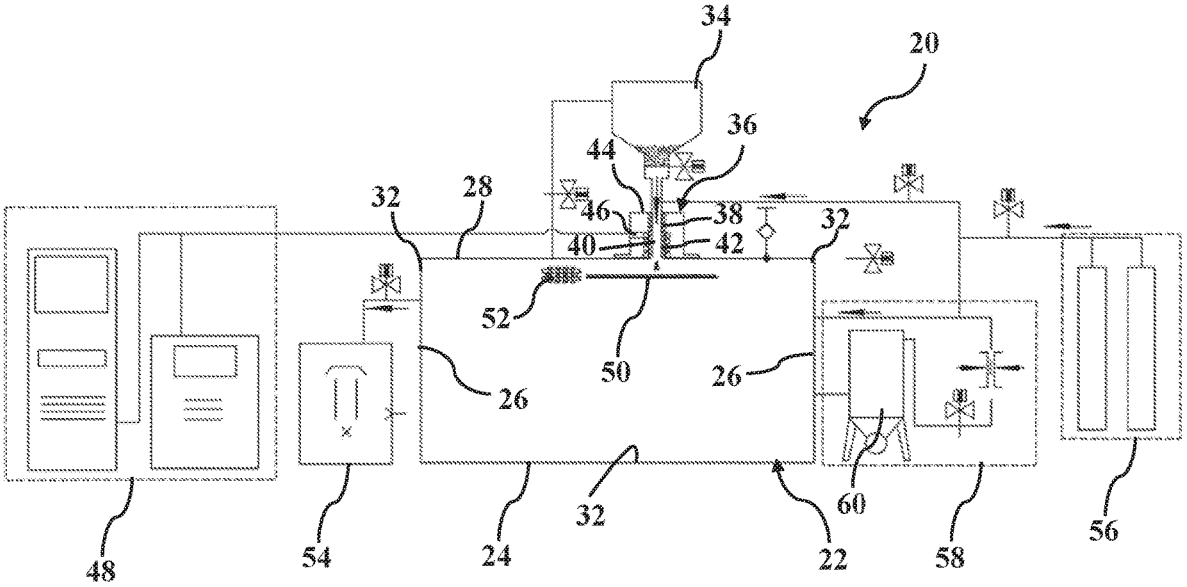
FIG. 1 is a schematic view of the plasma flame apparatus according to one embodiment of the present invention.

Referring to the Figures, wherein like numerals indicate corresponding parts throughout the several views, it is one aspect of the present invention to provide a method of manufacturing an R—Fe—B sintered magnet using a plasma flame apparatus 20 and a furnace. The plasma flame apparatus 20 has a chamber 32 and a plasma torch 36 connected to the chamber 32. A reaction gas, a carrier gas, and a cooling gas are connected to the plasma torch 36.

The first step of the method is providing a sintered magnet block having a composition of $R_1$-T-B-$M_1$ including a $R_2$—$Fe_{14}$—B main phase. In weight percentage, $R_1$ is present between 25 wt. % and 40 wt. % based on the total weight of the composition. $M_1$ is present between 0 wt. % and 4 wt. % based on the total weight of the composition, B is present between 0.8 wt. % and 1.5 wt. %, and the balance is T. $R_1$ is at least one rare earth element including Sc and Y. T is a transition selected from a group consisting of Fe or Co. B is Boron. $M_1$ is at least one element selected from a group consisting of Ti, Hf, V, Nb, Ta, Mn, Ni, Cu, Ag, Zn, Zr, Al, Ga, In, C, Si, Ge, Sn, Pb, N, P, Bi, S, Sb, or O.

The next step of the method is machining the sintered magnet block to form a plurality of machined magnets. In one embodiment of the present invention, each one of the machined magnets has a predetermined thickness of between 1 mm-12 mm. The step of machining can be further defined as subjecting the sintered magnet block to a cutting, grinding, and polishing the sintered magnet to produce the machined magnet block. The method proceeds with cleaning surfaces of the machined magnets to form a plurality of cleaned magnets. It should be appreciated that the step of cleaning the surfaces of the machined magnets can be performed by series of steps such as, but not limited to, degreasing, pickling, activating, and rinsing the surfaces of the machined magnets. In one embodiment of the present invention, the step of cleaning the surfaces of the machined magnets includes the steps of degreasing the surfaces of the machined magnets, pickling the surfaces of the machined magnets, activating the surfaces of the machined magnets, and rinsing the surfaces of the machined magnets using deionized water to produce the cleaned magnets.

Next, the method continues with depositing a plurality of spherical droplets of a heavy rare earth powder selected from at least one of Dy or Tb on the surfaces of the cleaned magnets in the chamber of the plasma flame apparatus 20. The step of depositing is conducted under an inert atmosphere of Argon and wherein the plurality of spherical droplets is in a predetermined pattern to produce a plurality of magnets including a uniform film of Dy or Tb. The plasma spheroidization process melts the heavy rare earth powder and forms spherically shaped droplets and allows for the deposition of the uniform film of Tb or Dy. In one embodiment of the present invention, the depositing includes a step of subjecting the heavy rare earth powder having a mesh size of between 50 and 200 mesh to a plasma spheroidization process using the plasma flame apparatus to form the plurality of spherical droplets. In one embodiment of the present invention, the step of depositing is further defined as depositing the plurality of spherical droplets of the heavy rare earth powder in the predetermined pattern of a long strip having a width of at least 1 mm on the cleaned magnets to produce the plurality of magnets having the uniform film defining a thickness of between 5 μm and 200 μm. In another embodiment of the present invention, the step of depositing is defined as depositing the plurality of spherical droplets of the heavy rare earth powder in the predetermined pattern of a circle having a diameter of at least 1 mm on the cleaned magnets to produce the plurality of magnets having the uniform film defining a thickness of between 5 μm and 200 μm. More preferably, the thickness of the uniform film is between 10 μm and 80 μm.

The step of depositing also includes a step of maintaining a predetermined Argon pressure of between 0.1 kPa and 0.1 MPa and an oxygen content of between 0 ppm and 500 ppm in the chamber. The step of depositing further including a step of adjusting a position of the plasma torch relative to the cleaned magnets to define a distance of between 5 mm and 20 mm between the cleaned magnets and the plasma torch.

The step of subjecting also includes a step of transferring the heavy rare earth powder to the plasma torch using the carrier gas, the reaction gas, and the cooling gas. A carrier gas source introduces the carrier gas at a flow rate of between 2 L/min and 10 L/min. A reaction gas source introduces the reaction gas at a flow rate of between 8 L/min and 20 L/min. A cooling gas source introduces the cooling gas at a flow rate of between 10 L/min and 30 L/min. As a result, the flow rate of the heavy rare earth powder being transferred to the plasma torch at is between 5 g/min and 20 g/min.

It is known in the art that the carrier gas, the reaction gas, and the cooling gas can be the same or different gases. The carrier gas that is usually introduced into the plasma torch through an injector at the center of the plasma torch. The purpose for the carrier gas is to convey the precursor, e.g. powders or liquid, into the plasma torch. It should be appreciated that Argon is the usual carrier gas, however, many other reactive gases (i.e., oxygen, $NH_3$, $CH_4$, etc.) are often involved in the carrier gas. For one embodiment of the present invention, Argon is used as the carrier gas. The reaction gas, also known as central gas or plasma forming gas can be introduced into the plasma torch by tangentially swirling. The swirling gas stream is maintained by an internal tube of the plasma torch that hoops the swirl to the level of the first turn of induction coil. For one embodiment of the present invention, Argon is used as the reaction gas. The cooling gas, more commonly known as sheath gas, is introduced in the plasma torch outside the internal tube. he function of sheath gas is twofold. It helps to stabilize the plasma discharge; most importantly, it protects the confinement tube, as a cooling medium. For one embodiment of the present invention, Argon is used as the cooling gas.

The method continues with sintering the magnets including the uniform film in the furnace under a negative atmosphere or an inert atmosphere and at a sintering temperature and sintering pressure to diffuse the uniform film into the magnets through grain boundary phases of the magnets. Because the uniform film has a uniform thickness, it is believed that the diffusion of the uniform film through the grain boundary phase is also uniform thereby allows for a uniform distribution of Tb or Dy in the magnets to improve the coercivity of the magnets. The step of sintering begins with spacing the magnets from one another. According to one embodiment of the present invention, the step of sintering is defined as heating the magnets including the uniform film under the negative atmosphere, at the sintering temperature of between 400° C. and 1000° C., and at the sintering pressure of between $1.0\times10^{-2}$ Pa and $1.0\times10^{-4}$ Pa for a duration of between 10 hours and 90 hours. According to another embodiment of the present invention, the step of sintering is defined as heating the magnets including the uniform film under the inert atmosphere of Argon, at the sintering temperature of between 400° C. and 1000° C., and at a sintering pressure of between 10 kPa and 30 kPa for a duration of between 10 hours and 90 hours to produce the R—Fe—B sintered magnets.

It is another aspect of the present invention to provide a plasma flame apparatus 20 for depositing a film of heavy rare earth elements on a plurality of magnets. As generally shown in FIG. 1, the plasma flame apparatus 20 includes a housing 22 having a generally rectangular shaped cross-section. The housing 22 includes a bottom wall 24, a pair of sidewalls 26, and a top wall 28. The pair of sidewalls 26 extends perpendicularly outwardly from the bottom wall 24 spaced from one another to a pair of distal ends 30 to define a chamber 32 extending between the sidewalls 26 and the bottom wall 24. The top wall 28 is attached to the sidewalls 26 and extends between the distal ends 30 to close the chamber 32. A hopper 34, made from a metal material, connects to the top wall 28 and in communication with the chamber 32, spaced from the top wall 28 for receiving a powder of a heavy rare earth element selected from a group consisting of Dy or Tb.

A plasma torch 36 including a body 38, having a generally tubular shape, connects the hopper 34 with the top wall 28. The body 38 defines a channel 40 disposed therein, extending between the hopper 34 and the top wall 28, and in communication with the hopper 34 and the chamber 32 for spheroidizing the powder for deposition on the magnets. A plurality of coils 42 extends helically about the body 38 for receiving a current to generate a plasma flame in the channel 40 for spheroidizing the powders. A sleeve 44, having a generally tubular shape, extends about the body 36. The sleeve defines a plurality of passages 46 connected to a water cooling system 48 for supplying a cooling fluid to the body 38 to cool and control the temperature of the plasma torch 36. The plasma torch can include a spark discharge device for generating a plasma flame. It should be appreciated that, in one embodiment of the present invention, the plasma torch 36 can include a plurality of three layers or tubes made from high temperature resistant quarts tubes or ceramic tubes. The layers in a concentric relationship with one another whereby each of the three layers has a different size relative to one another for adjusting width of the film and deposition speed.

A conveyor 50 is disposed in the chamber 32 and is movably attached to the housing 22. The conveyor 50 is located directly below the plasma torch 36 for receiving and transporting the plurality of magnets to the plasma torch 36 to allow the plasma torch 36 to deposit the film of heavy rare earth elements on one surface of the plurality of magnets. It should be appreciated that, in one embodiment of the present invention, the conveyor is a plate chain conveyor for transporting the plurality of magnets. A flip member 52 is disposed in the chamber 32, adjacent and spaced from the conveyor 50, and attached to the housing 22 for inverting the magnets and allow the plasma torch 36 to deposit the film of heavy rare earth elements on another surface of the magnets.

A vacuum system 54 is disposed adjacent to one of the sidewalls 26 and in communication with the chamber 32 for drawing air from the chamber 32 to provide a negative atmosphere when depositing the film of heavy rare earth elements on one surface of the plurality of magnets. A gas supply system 56 is disposed in communication with the hopper 34 and the channel 40. The gas supply system 56 includes a reaction gas source, a carrier gas source, and a cooling gas source. The reaction gas source, the carrier gas source, and the cooling gas source is fed through the channel 40 of the plasma torch 36 adjacent to the hopper 34 for transporting the powder of the heavy rare earth element from the hopper 34 to the plasma torch 36 for spheroidizing the powder. It should be appreciated that the reaction gas source, the carrier gas source, and the cooling gas source can be the same or different types of gases. In one embodiment of the present invention, Argon is used as the carrier gas, the reaction gas, and the cooling gas. An Argon circulation system 58 is disposed in communication with the chamber 32 for circulating and purifying Argon in the chamber 32 to provide an inert atmosphere when depositing the film of heavy rare earth elements on one surface of the plurality of magnets. The argon circulation system 58 includes a purifier 60 disposed in communication with the chamber 32. The purifier 60 is adapted to remove Argon gas from the chamber 32 and filter, clean, and compress the Argon gas to circulate the Argon gas in the chamber 32.

In operation, a current of 27.12 MHz is first sent through the coils 42 from a power supply having a power of 6000 W. At the same time, the spark discharge device in the plasma torch 36 activates the reaction gas to generate a plasma flame. The heavy rare earth element of Dy or Tb falls from the hopper 34, carried by the carrier gas, to the plasma flame. Accordingly, the heavy rare earth element absorbs heat from the plasma flame and melts. At the same time, the plasma torch 36 spheroidizes the melted heavy rare earth element into spherical droplets under actions of surface tension and electromagnetic force. Then, a plurality of magnets are disposed on the conveyor 50 to transfer the magnets to the plasma torch 36. Next, the spherical droplets are disposed on a surface of the magnets at a specific location and in a predetermined pattern to form a uniform film of Dy or Tb on the magnets. Throughout the deposition process, the flow rate of the carrier gas, the reaction gas, and the cooling gas are controlled to control the speed of deposition for the uniform film on the magnets. Then, the magnets are turned over using the flip member 52 to allow the plasma torch 36 to deposit the uniform film on another surface of the magnet. Afterward, the magnet including the uniform film is placed in a furnace under a negative atmosphere or an inert atmosphere. When the step of sintering is conducted under the negative atmosphere, the sintering pressure is between $1.0\times10^{-2}$ Pa and $1.0\times10^{-4}$ Pa. The sintering temperature is between 400° C. and 1000° C. for a duration of between 10 hours and 90 hours. When the step of sintering is conducted under the inert atmosphere, the inert atmosphere is created using Argon and the sintering pressure is between 10 kPa and 30 kPa defined as heating the magnets including the uniform film under the inert atmosphere of Argon. The sintering temperature is between 400° C. and 1000° C. for a duration of between 10 hours and 90 hours.

The examples below provide a better illustration of the present invention. The examples are used for illustrative purposes only and do not limit the scope of the present invention.

Implementing Example 1

In Implementing Example 1, a sintered magnet block is first provided by smelting a raw material under an inert atmosphere of to obtain a metal alloy. The metal alloy has a composition including, in weight percentage, Nd being 24.5 wt. % based on the total weight of the composition, Pr being 6 wt. % based on the total weight of the composition, B being 1 wt. % based on the total weight of the composition, Co being 1.5 wt. % based on the total weight of the composition, Ti being 0.1 wt. % based on the total weight of the composition, Al being 0.5 wt. % based on the total weight of the composition, Cu being 0.2 wt. % based on the total weight of the composition, Ga being 0.2 wt. % based on the total weight of the composition, and the balance being Fe. The metal alloy is subjected to a strip casting process to obtain a sheet-like alloy having a thickness of between 0.2 mm and 0.5 mm. Then, the sheet-like alloy is subjected to a decrepitation process under hydrogen. After the decrepitation process, the sheet-like alloy is subjected to a pulverization process in a jet mill to produce a fine powder having an average size of $X_{50}$=4.0 μm. Next, the fined powder is compacted under a magnetic field having a magnetic flux of 2T to obtain a green compact. The green compact is then sintered at 1050° C. for 4 hours and aged at 480° C. for 3 hours to obtain the sintered magnet block. Next, the sintered magnet block is machined to form a plurality of machined magnets. The machined magnets has a size of 20 mm×16 mm×1.8 mm. Then, the surfaces of the machined magnets are cleaned, e.g. degreasing, pickling, activating, rinsing, and drying the surfaces of the machined magnets, to form a plurality of cleaned magnets. The cleaned magnets shall be denoted as B1.

Approximately 300 pieces of the cleaned magnets are placed in the chamber 32 of the plasma flame apparatus 20. The flow rates of the carrier, reaction, and cooling gases are adjusted to be 2 L/min, 8 L/min, and 10 L/min, respectively. Then, the vacuum system 54 and the argon circulation system 58 are adjusted to ensure an argon pressure in the chamber is below 0.1 kPa and oxygen content is below 500 ppn. The velocity of the heavy rare earth powder of Tb is fed into the plasma torch 36 at 5 g/min. The particle size of the heavy rare earth powder of Tb is between 50 μm and 100 μm. The distance between the plasma torch 36 and upper surfaces of the cleaned magnets is maintained at 5 mm. The carrier gas transports the heavy rare earth powder of Tb to the plasma torch 36 wherein the heavy rare earth powder of Tb rapidly absorbs heat and melts to form the spherical droplets. Next, the spherical droplets are deposited onto a surface of the cleaned magnets. Then, the flip member 52 turns over the cleaned magnets to allow for the deposition of the spherical droplets onto another surface of the cleaned magnets to produce the plurality of magnets having the uniform film of Tb. The uniform film of Tb has a thickness of 10 μm.

Then, the plurality of magnets having the uniform film of Tb is sintered in the furnace under a negative atmosphere and at a sintering temperature of 900° C. and a sintering pressure of between $10^{-2}$ Pa and $10^{-3}$ Pa for a duration of 6 hours. Then, the magnets are subjected to an aging treatment under an gaining temperature of 400° C. for a duration of 4 hours whereby Argon is introduced into the furnace as a cooling gas used to reduce the sintering temperature from 900° C. to 400° C. to produce the R—Fe—B sintered magnets. Three of the R—Fe—B sintered magnets are selected for analysis and the selected R—Fe—B sintered magnets are denoted as S1, S2, S3. The magnetic properties for the R—Fe—B sintered magnets are set forth below in Table 1.

Comparative Example 1

In Comparative Example 1, a sintered magnet block is first provided by smelting a raw material under an inert atmosphere of to obtain a metal alloy. The metal alloy has a composition including, in weight percentage, Tb being 3.5 wt. % based on the total weight of the composition, Nd being 21.8 wt. % based on the total weight of the composition, Pr being 5.5 wt. % based on the total weight of the composition, B being 0.98 wt. % based on the total weight of the composition, Co being 1.1 wt. % based on the total weight of the composition, Ti being 0.1 wt. % based on the total weight of the composition, Al being 0.1 wt. % based on the total weight of the composition, Cu being 0.2 wt. % based on the total weight of the composition, Ga being 0.2 wt. % based on the total weight of the composition, and the balance being Fe. The metal alloy is subjected to a strip casting process to obtain a sheet-like alloy having a thickness of between 0.2 mm and 0.5 mm. Then, the sheet-like alloy is subjected to a decrepitation process under hydrogen. After the decrepitation process, the sheet-like alloy is subjected to a pulverization process in a jet mill to produce a fine powder having an average size of $X_{50}$=4.0 μm. Next, the fined powder is compacted under a magnetic field having a magnetic flux of 2 T to obtain a green compact. The green compact is then sintered at 1080° C. for 4 hours and aged at 500° C. for 3 hours to obtain the sintered magnet block. Next, the sintered magnet block is machined to form a plurality of machined magnets. The machined magnets has a size of 20 mm×16 mm×1.8 mm. The machined magnets are denoted as D1, D2, D3. The magnetic properties for the machined magnets are set forth below in Table 2.

Comparative Example 2

In Comparative Example 2, a sintered magnet block is first provided by smelting a raw material under an inert atmosphere of to obtain a metal alloy. The metal alloy has a composition including, in weight percentage, Nd being 24.5 wt. % based on the total weight of the composition, Pr being 6 wt. % based on the total weight of the composition, B being 1 wt. % based on the total weight of the composition, Co being 1.5 wt. % based on the total weight of the composition, Ti being 0.1 wt. % based on the total weight of the composition, Al being 0.5 wt. % based on the total weight of the composition, Cu being 0.2 wt. % based on the total weight of the composition, Ga being 0.2 wt. % based on the total weight of the composition, and the balance being Fe. The metal alloy is subjected to a strip casting process to obtain a sheet-like alloy having a thickness of between 0.2 mm and 0.5 mm. Then, the sheet-like alloy is subjected to a decrepitation process under hydrogen. After the decrepitation process, the sheet-like alloy is subjected to a pulverization process in a jet mill to produce a fine powder having an average size of $X_{50}$=4.0 μm. Next, the fined powder is compacted under a magnetic field having a magnetic flux of 2 T to obtain a green compact. The green compact is then sintered at 1050° C. for 4 hours and aged at 480° C. for 3 hours to obtain the sintered magnet block. Next, the sintered magnet block is machined to form a plurality of machined magnets. The machined magnets has a size of 20 mm×16 mm×1.8 mm. Then, the surfaces of the machined magnets are cleaned, e.g. degreasing, pickling, activating, rinsing, and drying the surfaces of the machined magnets, to form a plurality of cleaned magnets.

Then, a uniform film of Tb and having a thickness of 10 μm is disposed on the surfaces of the cleaned magnets using a vapor deposition process to produce a plurality of magnets having the uniform film of Tb. Then, the plurality of magnets having the uniform film of Tb is sintered in the furnace under a negative atmosphere and at a sintering temperature of 900° C. and a sintering pressure of between $10^{-2}$ Pa and $10^{-3}$ Pa for a duration of 6 hours. Then, the magnets are subjected to an aging treatment at an aging temperature of 400° C. for a duration of 4 hours whereby Argon is introduced into the furnace as a cooling gas used to reduce the sintering temperature from 900° C. to 400° C. to produce the R—Fe—B sintered magnets. Three of the R—Fe—B sintered magnets are selected for analysis and the selected R—Fe—B sintered magnets are denoted as Z1, Z2, Z3. The magnetic properties for the R—Fe—B sintered magnets are set forth below in Table 3.

TABLE 1

Magnetic Properties of the R—Fe—B Sintered Magnets of Implementing Example 1

| Sample No. | Br (kGs) | Hcj (kOe) | $(BH)_{max}$ | Hk/Hcj |
|---|---|---|---|---|
| B1 | 13.77 | 15.39 | 45.22 | 0.98 |
| S1 | 13.65 | 24.8 | 44.72 | 0.96 |
| S2 | 13.58 | 25.11 | 44.17 | 0.97 |
| S3 | 13.62 | 24.77 | 44.44 | 0.96 |

TABLE 2

Magnetic Properties of the Machined Magnets of Comparative Example 1

| Sample No. | Br (kGs) | Hcj (kOe) | $(BH)_{max}$ | Hk/Hcj |
|---|---|---|---|---|
| D1 | 13.6 | 24.82 | 44.36 | 0.98 |
| D2 | 13.62 | 24.71 | 44.55 | 0.97 |
| D3 | 13.57 | 25.36 | 44.21 | 0.96 |

TABLE 3

Magnetic Properties of the R—Fe—B Sintered Magnets of Comparative Example 2

| Sample No. | Br (kGs) | Hcj (kOe) | $(BH)_{max}$ | Hk/Hcj |
|---|---|---|---|---|
| Z1 | 13.59 | 24.52 | 44.43 | 0.95 |
| Z2 | 13.63 | 24.31 | 44.25 | 0.97 |
| Z3 | 13.60 | 24.76 | 44.31 | 0.94 |

In tables 1-3, Br is remanence of the magnets. Hcj is the coercivity of the magnets. $(BH)_{max}$ denotes maximum energy product. Hk/Hcj is the demagnetization curve squareness for the magnets.

Comparing the magnetic properties of B1 with S1, S2, and S3, it is evident that the R—Fe—B Sintered Magnets obtained by surface deposition and heat treatment exhibit an increase in Coercivity (Hcj) from 15.39 kOe to 24.8 kOe, 24.71 kOe and 25.36 kOe, respectively. In addition, the R—Fe—B Sintered Magnets exhibit a slight reduction in their remanence, squareness and maximum energy product. When the magnets are crushed, a composition analysis indicates that the magnets has a Tb content of 0.6 wt. %.

Comparing the magnetic properties for the R—Fe—B Sintered Magnets of Implementing Example 1, e.g. S1, S2, and S3, with the machined magnets of Comparative Example 1, e.g. D1, D2 and D3, although the magnetic properties for both magnets are similar. A composition analysis revealed that the magnets from Comparative Example 1 has a Tb content of 3.5 wt. % while the magnets of Implementing Example 1 has a Tb content of 0.6 wt. %. Accordingly, in can be concluded that the magnets of Implementing Example 1 have the same magnetic properties as the magnets of Comparative Example 1 while the use of heavy rare earth elements is greatly reduced.

The magnetic properties for the R—Fe—B Sintered Magnets of Implementing Example 1 and the R—Fe—B Sintered Magnets of Comparative Example 2 are similar. However, using the plasma torch apparatus to deposit uniform film of Tb on the cleaned magnets greatly improves the material utilization rate of the heavy rare earth metal powder of Tb.

Implementing Example 2

In Implementing Example 2, a sintered magnet block is first provided by smelting a raw material under an inert atmosphere of to obtain a metal alloy. The metal alloy has a composition including, in weight percentage, Nd being 26 wt. % based on the total weight of the composition, Pr being 6.5 wt. % based on the total weight of the composition, B being 0.97 wt. % based on the total weight of the composition, Co being 2 wt. % based on the total weight of the composition, Ti being 0.1 wt. % based on the total weight of the composition, Al being 0.7 wt. % based on the total weight of the composition, Cu being 0.15 wt. % based on the total weight of the composition, Ga being 0.2 wt. % based on the total weight of the composition, and the balance being Fe. The metal alloy is subjected to a strip casting process to obtain a sheet-like alloy having a thickness of between 0.2 mm and 0.5 mm. Then, the sheet-like alloy is subjected to a decrepitation process under hydrogen. After the decrepitation process, the sheet-like alloy is subjected to a pulverization process in a jet mill to produce a fine powder having an average size of $X_{50}$=4.8 μm. Next, the fined powder is compacted under a magnetic field having a magnetic flux of 2T to obtain a green compact. The green compact is then sintered at 1080° C. for 4 hours and aged at 520° C. for 3 hours to obtain the sintered magnet block. Next, the sintered magnet block is machined to form a plurality of machined magnets. The machined magnets has a size of 20 mm×16 mm×12 mm. Then, the surfaces of the machined magnets are cleaned, e.g. degreasing, pickling, activating, rinsing, and drying the surfaces of the machined magnets, to form a plurality of cleaned magnets. The cleaned magnets shall be denoted as B2.

Approximately 300 pieces of the cleaned magnets are placed in the chamber 32 of the plasma flame apparatus 20. The flow rates of the carrier, reaction, and cooling gases are adjusted to be 10 L/min, 20 L/min, and 30 L/min, respectively. Then, the vacuum system 54 and the argon circulation system 58 are adjusted to ensure the argon pressure in the chamber 32 is below 0.08 MPa and the oxygen content is below 500 ppn. The velocity of the heavy rare earth powder of Dy is fed into the plasma torch 36 at 20 g/min. The particle size of the heavy rare earth powder of Dy is between 100 μm and 200 μm. The distance between the plasma torch 36 and upper surfaces of the cleaned magnets is maintained at 20 mm. The carrier gas transports the heavy rare earth powder of Dy to the plasma torch 36 wherein the heavy rare earth powder of Dy rapidly absorbs heat and melts to form the spherical droplets. Next, the spherical droplets are deposited onto a surface of the cleaned magnets. Then, the flip member 52 turns over the cleaned magnets to allow for the deposition of the spherical droplets onto another surface of the cleaned magnets to produce the plurality of magnets having the uniform film of Dy. The uniform film of Dy has a thickness of 80 μm.

Then, the plurality of magnets having the uniform film of Dy is sintered in the furnace under a negative atmosphere and at a sintering temperature of 960° C. and a sintering pressure of between $10^{-2}$ Pa and $10^{-3}$ Pa for a duration of 84 hours. Then, the magnets are subjected to an aging treatment under an aging temperature of 500° C. for a duration of 6 hours whereby Argon is introduced into the furnace as a cooling gas used to reduce the sintering temperature from 960° C. to 400° C. to produce the R—Fe—B sintered magnets. Three of the R—Fe—B sintered magnets are selected for analysis and the selected R—Fe—B sintered magnets are denoted as S4, S5, S6. The magnetic properties for the R—Fe—B sintered magnets are set forth below in Table 4.

Comparative Example 3

In Comparative Example 3, a sintered magnet block is first provided by smelting a raw material under an inert atmosphere of to obtain a metal alloy. The metal alloy has a composition including, in weight percentage, Dy being 2.5 wt. % based on the total weight of the composition, Nd being 21.5 wt. % based on the total weight of the composition, Pr being 7 wt. % based on the total weight of the composition, B being 0.95 wt. % based on the total weight of the composition, Co being 1.1 wt. % based on the total weight of the composition, Ti being 0.1 wt. % based on the total weight of the composition, Al being 0.2 wt. % based on the total weight of the composition, Cu being 0.15 wt. % based on the total weight of the composition, Ga being 0.2 wt. % based on the total weight of the composition, and the balance being Fe. The metal alloy is subjected to a strip casting process to obtain a sheet-like alloy having a thickness of between 0.2 mm and 0.5 mm. Then, the sheet-like alloy is subjected to a decrepitation process under hydrogen. After the decrepitation process, the sheet-like alloy is subjected to a pulverization process in a jet mill to produce a fine powder having an average size of $X_{50}$=4.5 μm. Next, the fined powder is compacted under a magnetic field having a magnetic flux of 2 T to obtain a green compact. The green compact is then sintered at 1070° C. for 4 hours and aged at 500° C. for 3 hours to obtain the sintered magnet block. Next, the sintered magnet block is machined to form a plurality of machined magnets. The machined magnets has a size of 20 mm×16 mm×1.8 mm. The machined magnets are denoted as D4, D5, D6. The magnetic properties for the machined magnets are set forth below in Table 5.

Comparative Example 4

In Comparative Example 4, a sintered magnet block is first provided by smelting a raw material under an inert atmosphere of to obtain a metal alloy. The metal alloy has a composition including, in weight percentage, Nd being 26 wt. % based on the total weight of the composition, Pr being 6.5 wt. % based on the total weight of the composition, B being 0.97 wt. % based on the total weight of the composition, Co being 2 wt. % based on the total weight of the composition, Ti being 0.1 wt. % based on the total weight of the composition, Al being 0.7 wt. % based on the total weight of the composition, Cu being 0.15 wt. % based on the total weight of the composition, Ga being 0.2 wt. % based on the total weight of the composition, and the balance being Fe. The metal alloy is subjected to a strip casting process to obtain a sheet-like alloy having a thickness of between 0.2 mm and 0.5 mm. Then, the sheet-like alloy is subjected to a decrepitation process under hydrogen. After the decrepitation process, the sheet-like alloy is subjected to a pulverization process in a jet mill to produce a fine powder having an average size of $X_{50}$=Next, the fined powder is compacted under a magnetic field having a magnetic flux of 2 T to obtain a green compact. The green compact is then sintered at 1080° C. for 4 hours and aged at 520° C. for 3 hours to obtain the sintered magnet block. Next, the sintered magnet block is machined to form a plurality of machined magnets. The machined magnets has a size of 20 mm×16 mm×12 mm. Then, the surfaces of the machined magnets are cleaned, e.g. degreasing, pickling, activating, rinsing, and drying the surfaces of the machined magnets, to form a plurality of cleaned magnets.

Then, a uniform film of Dy and having a thickness of 80 μm is disposed on the surfaces of the cleaned magnets using a vapor deposition process to produce a plurality of magnets having the uniform film of Dy. Next, the plurality of magnets having the uniform film of Dy is sintered in the furnace under a negative atmosphere and at a sintering temperature of 960° C. and a sintering pressure of between $10^{-2}$ Pa and $10^{-3}$ Pa for a duration of 84 hours. Then, the magnets are subjected to an aging treatment under an aging temperature of 500° C. for a duration of 6 hours whereby Argon is introduced into the furnace as a cooling gas used to reduce the sintering temperature from 960° C. to 400° C. to produce the R—Fe—B sintered magnets. Three of the R—Fe—B sintered magnets are selected for analysis and the selected R—Fe—B sintered magnets are denoted as Z4, Z5, Z6. The magnetic properties for the R—Fe—B sintered magnets are set forth below in Table 6.

TABLE 4

Magnetic Properties of the R—Fe—B Sintered Magnets of Implementing Example 2

| Sample No. | Br (kGs) | Hcj (kOe) | $(BH)_{max}$ | Hk/Hcj |
|---|---|---|---|---|
| B1 | 13.26 | 16.6 | 42.4 | 0.96 |
| S4 | 13.12 | 21.72 | 42.69 | 0.96 |
| S5 | 13.1 | 21.8 | 42.54 | 0.97 |
| S6 | 13.11 | 21.61 | 42.58 | 0.96 |

TABLE 5

Magnetic Properties of the Machined Magnets of Comparative Example 3

| Sample No. | Br (kGs) | Hcj (kOe) | $(BH)_{max}$ | Hk/Hcj |
|---|---|---|---|---|
| D4 | 13.01 | 21.65 | 42.05 | 0.95 |
| D5 | 13.08 | 21.42 | 42.44 | 0.97 |
| D6 | 13.1 | 21.36 | 42.55 | 0.96 |

TABLE 6

Magnetic Properties of the R—Fe—B Sintered Magnets of Comparative Example 4

| Sample No. | Br (kGs) | Hcj (kOe) | $(BH)_{max}$ | Hk/Hcj |
|---|---|---|---|---|
| Z4 | 13.11 | 21.45 | 42.73 | 0.94 |
| Z5 | 13.02 | 21.72 | 42.14 | 0.95 |
| Z6 | 12.99 | 21.96 | 41.95 | 0.97 |

Comparing the magnetic properties of B2 with S4, S5, and S6, it is evident that the R—Fe—B Sintered Magnets obtained by surface deposition and heat treatment exhibit an increase in Coercivity (Hcj) from 16.6 kOe to 21.72 kOe, 21.8 kOe and 21.61 kOe, respectively. In addition, the R—Fe—B Sintered Magnets exhibit a slight reduction in their remanence, squareness and maximum energy product. When the magnets are crushed, a composition analysis indicates that the magnets has a Dy content of 0.85 wt. %.

Comparing the magnetic properties for the R—Fe—B Sintered Magnets of Implementing Example 2, e.g. S4, S5, and S6, with the machined magnets of Comparative Example 3, e.g. D4, D5 and D6, although the magnetic properties for both magnets are similar. A composition analysis revealed that the magnets from Comparative Example 3 has a Dy content of 2.5 wt. % while the magnets of Implementing Example 1 has a Dy content of 0.85 wt. %. Accordingly, in can be concluded that the magnets of Implementing Example 2 have the same magnetic properties as the magnets of Comparative Example 3 while the use of heavy rare earth elements is greatly reduced.

The magnetic properties for the R—Fe—B Sintered Magnets of Implementing Example 2 and the R—Fe—B Sintered Magnets of Comparative Example 4 are similar. However, using the plasma torch apparatus to deposit uniform film of Dy on the cleaned magnets greatly improves the material utilization rate of the heavy rare earth metal powder of Dy.

Implementing Example 3

In Implementing Example 3, a sintered magnet block is first provided by smelting a raw material under an inert atmosphere of to obtain a metal alloy. The metal alloy has a composition including, in weight percentage, Nd being 24.5 wt. % based on the total weight of the composition, Pr being 6 wt. % based on the total weight of the composition, B being 1 wt. % based on the total weight of the composition, Co being 1.5 wt. % based on the total weight of the composition, Ti being 0.1 wt. % based on the total weight of the composition, Al being 0.5 wt. % based on the total weight of the composition, Cu being 0.2 wt. % based on the total weight of the composition, Ga being 0.2 wt. % based on the total weight of the composition, and the balance being Fe. The metal alloy is subjected to a strip casting process to obtain a sheet-like alloy having a thickness of between 0.2 mm and 0.5 mm. Then, the sheet-like alloy is subjected to a decrepitation process under hydrogen. After the decrepitation process, the sheet-like alloy is subjected to a pulverization process in a jet mill to produce a fine powder having an average size of $X_{50}$=4.0 μm. Next, the fined powder is compacted under a magnetic field having a magnetic flux of 2 T to obtain a green compact. The green compact is then sintered at 1050° C. for 4 hours and aged at 480° C. for 3 hours to obtain the sintered magnet block. Next, the sintered magnet block is machined to form a plurality of machined magnets. The machined magnets has a size of 20 mm×16 mm×1.8 mm. Then, the surfaces of the machined magnets are cleaned, e.g. degreasing, pickling, activating, rinsing, and drying the surfaces of the machined magnets, to form a plurality of cleaned magnets. The cleaned magnets are denoted as B1.

Figure 2:
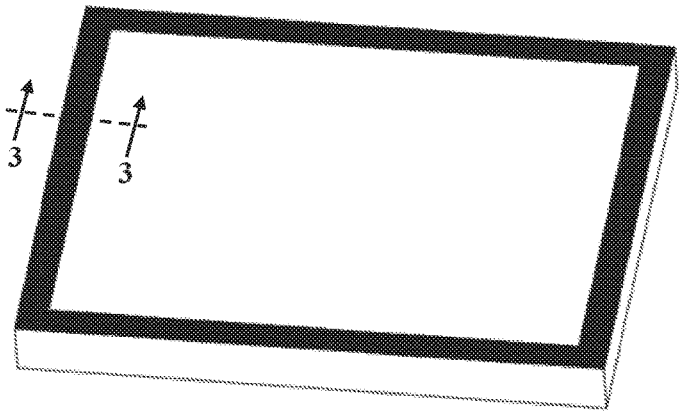
FIG. 2 is a perspective view of the cleaned magnet of Implementing Example 3 including a uniform film disposed along the periphery of the cleaned magnet.

The cleaned magnets are placed in the chamber 32 of the plasma flame apparatus 20. The flow rates of the carrier, reaction, and cooling gases are adjusted to be 2 L/min, 8 L/min, and 10 L/min, respectively. Then, the vacuum system 54 and the argon circulation system 58 are adjusted to ensure the argon pressure in the chamber 32 is below 0.1 kPa and the oxygen content is below 500 ppn. The velocity of the heavy rare earth powder of Tb is fed into the plasma torch 36 at 5 g/min. The particle size of the heavy rare earth powder of Tb is between 50 μm and 100 μm. The distance between the plasma torch 36 and upper surfaces of the cleaned magnets is maintained at 5 mm. The carrier gas transports the heavy rare earth powder of Tb to the plasma torch 36 wherein the heavy rare earth powder of Tb rapidly absorbs heat and melts to form the spherical droplets. Next, as best illustrated in FIG. 2, the spherical droplets are deposited onto a surface of the cleaned magnets in a predetermined pattern of a long strip along the periphery of the cleaned magnets which is also perpendicular to the direction of magnetization. The long strip has a width of 1 mm to produce the plurality of magnets having the uniform film of Tb. The uniform film of Tb has a thickness of 10 μm.

Figure 3:
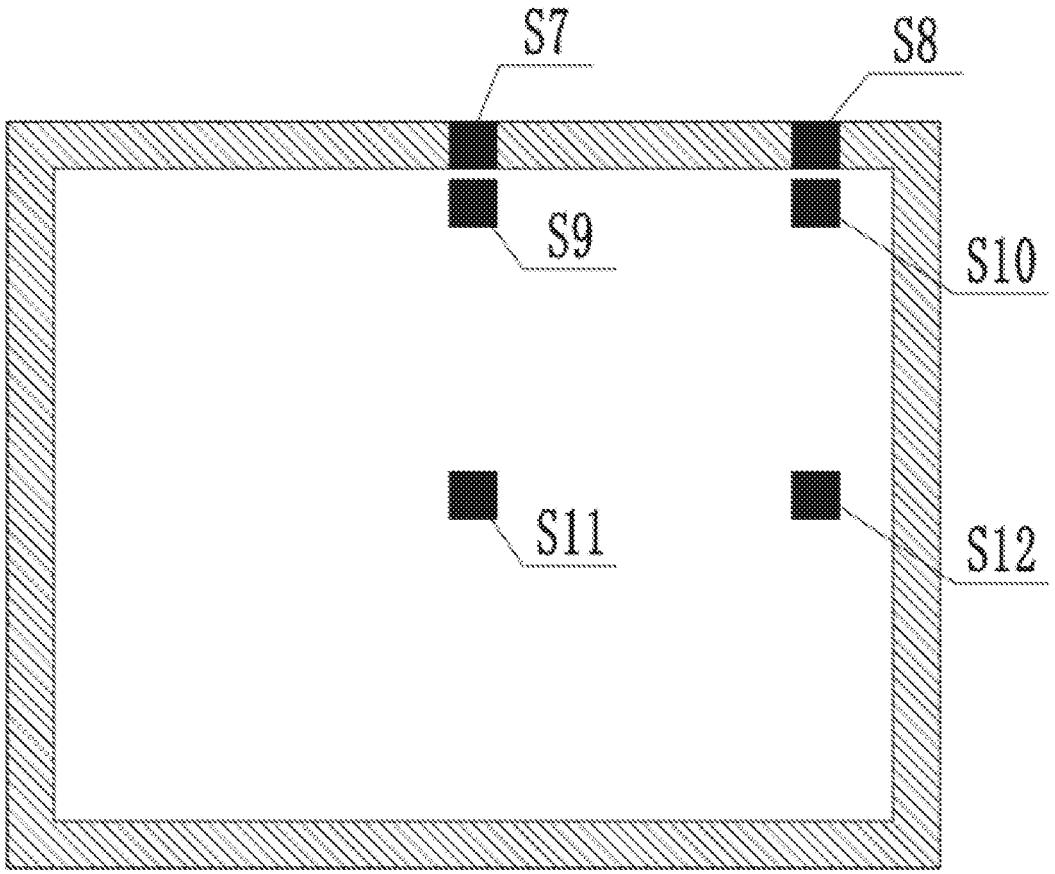
FIG. 3 is a cross-sectional view of the cleaned magnet of Implementing Example 3.

Then, the plurality of magnets having the uniform film of Tb is sintered in the furnace under a negative atmosphere and at a sintering temperature of 900° C. and a sintering pressure of between $10^{-2}$ Pa and $10^{-3}$ Pa for a duration of 6 hours. Then, the magnets are subjected to an aging treatment under an gaining temperature of 400° C. for a duration of 4 hours whereby Argon is introduced into the furnace as a cooling gas used to reduce the sintering temperature from 900° C. to 400° C. to produce the R—Fe—B sintered magnets. After sintering and aging, the R—Fe—B sintered magnets are cut to a dimension of 1 mm×1 mm in length and width with the height being the thickness of the R—Fe—B sintered magnets. As best illustrated in FIG. 3, the magnetic properties of different areas of the R—Fe—B sintered magnets, e.g. S7-S12, are analyzed wherein S7 and S8 are in the edge region of the deposition, while S9-S12 are inside the magnet, i.e. the undeposited area. The magnetic properties for the R—Fe—B sintered magnets are set forth below in Table 7.

TABLE 7

Magnetic Properties of the R—Fe—B Sintered Magnets of Implementing Example 3

| Sample No. | Br (kGs) | Hcj (kOe) | $(BH)_{max}$ | Hk/Hcj |
|---|---|---|---|---|
| B1 | 13.77 | 15.39 | 45.22 | 0.98 |
| S7 | 13.66 | 24.81 | 44.53 | 0.95 |

TABLE 7-continued

Magnetic Properties of the R—Fe—B Sintered Magnets of Implementing Example 3

| Sample No. | Br (kGs) | Hcj (kOe) | $(BH)_{max}$ | Hk/Hcj |
|---|---|---|---|---|
| S8 | 13.59 | 25.22 | 43.97 | 0.96 |
| S9 | 13.76 | 15.42 | 45.12 | 0.97 |
| S10 | 13.78 | 15.36 | 45.21 | 0.98 |
| S11 | 13.71 | 15.59 | 44.68 | 0.96 |
| S12 | 13.82 | 15.37 | 45.51 | 0.97 |

Based on the data of Table 7, the coercivity of the S7 and S8, e.g. deposition area, has improved greatly, i.e. from 15.39 kOe to 24.81 kOe and 25.22 kOe, respectively. On the other hand, the coercivity of S9-S12, e.g. the undeposited area, remained unchanged.

Obviously, many modifications and variations of the present invention are possible in light of the above teachings and may be practiced otherwise than as specifically described while within the scope of the appended claims. These antecedent recitations should be interpreted to cover any combination in which the inventive novelty exercises its utility. The use of the word "said" in the apparatus claims refers to an antecedent that is a positive recitation meant to be included in the coverage of the claims whereas the word "the" precedes a word not meant to be included in the coverage of the claims.

What is claimed is:

1. A method of manufacturing a plurality of R—Fe—B sintered magnets using a plasma flame apparatus and a furnace, the plasma flame apparatus having a plasma torch connected to a chamber and including a reaction gas, a carrier gas, and a cooling gas connected to the plasma torch, said method comprising the steps of:

providing a sintered magnet block having a composition of $R_1$-T-B-$M_1$ with $R_1$ being present between 25 wt. % and 40 wt. % based on the total weight of the composition, $M_1$ being present between 0 wt. % and 4 wt. % based on the total weight of the composition, B being present between 0.8 wt. % and 1.5 wt. %, and the balance being T, wherein $R_1$ is at least one rare earth element selected from a group consisting of Sc and Y, T is a transition metal selected from a group consisting of Fe and Co, B is Boron, $M_1$ is at least one element selected from a group consisting of Ti, Zr, Hf, V, Nb, Ta, Mn, Ni, Cu, Ag, Zn, Al, Ga, In, C, Si, Ge, Sn, Pb, N, P, Bi, S, Sb, and O;

machining the sintered magnet block to form a plurality of machined magnets;

cleaning surfaces of the machined magnets to form a plurality of cleaned magnets;

depositing a plurality of spherical droplets of a heavy rare earth powder selected from a group consisting of Dy and Tb on the surfaces of the cleaned magnets in the chamber of the plasma flame apparatus under an inert atmosphere of Argon and in a predetermined pattern to produce a plurality of magnets including a uniform film of Dy or Tb; and sintering the magnets including the uniform film in the furnace under a negative atmosphere or an inert atmosphere and at a sintering temperature and a sintering pressure to diffuse the uniform film into the magnets through grain boundary phases of the magnets to produce the R—Fe—B sintered magnets;

wherein said step of depositing further comprises the steps of:

subjecting the heavy rare earth powder having a mesh size of between 50 mesh and 200 mesh to a plasma spheroidization process using the plasma flame apparatus to form the plurality of spherical droplets:

transferring the heavy rare earth powder to the plasma torch using a carrier gas, a reaction gas, and the cooling gas, the carrier gas at a flow rate of between 2 L/min and 10 L/min, the reaction gas at a flow rate of between 8 L/min and 20 L/min, and the cooling gas at a flow rate of between 10 L/min and 30 L/min, whereby the heavy rare earth powder is being transferred at a flow rate of between 5 g/min and 20 g/min;

maintaining a predetermined Argon pressure of between 0.1 k Pa and 0.1 MPa and an oxygen content of between 0 ppm and 500 ppm in the chamber: and adjusting a position of the plasma torch relative to the cleaned magnets to define a distance of between 5 mm and 20 mm between the cleaned magnets and the plasma torch.

2. The method as set forth in claim 1, wherein said step of depositing is further defined as depositing the plurality of spherical droplets of the heavy rare earth powder in the predetermined pattern of a long strip having a width of at least 1 mm on the cleaned magnets to produce the plurality of magnets having the uniform film defining a thickness of between 5 μm and 200 μm.

3. The method as set forth in claim 2, wherein said step of depositing is further defined as depositing the plurality of spherical droplets of the heavy rare earth powder on the surfaces of the cleaned magnets in the predetermined pattern to produce the plurality of magnets including a uniform film defining a thickness of between 10 μm and 80 μm.

4. The method as set forth in claim 1, wherein said step of depositing being further defined as depositing the plurality of spherical droplets of the heavy rare earth powder in the predetermined pattern of a circle having a diameter of at least 1 mm on the cleaned magnets to produce the plurality of magnets having the uniform film defining a thickness of between 5 μm and 200 μm.

5. The method as set forth in claim 4, wherein said step of depositing is further defined as depositing the plurality of droplets of the heavy rare earth powder on the surfaces of the cleaned magnets in the predetermined pattern to produce the plurality of magnets including a uniform film defining a thickness of between 10 μm and 80 μm.

6. The method as set forth in claim 1, wherein said step of sintering includes a step of spacing the magnets from one another.

7. The method as set forth in claim 1, wherein said step of sintering is defined as heating the magnets including the uniform film under the negative atmosphere, at the sintering temperature of between 400° C. and 1000° C., and at the sintering pressure of between $1.0\times10^{-2}$ Pa and $1.0\times10^{-4}$ Pa for a duration of between 10 hours and 90 hours.

8. The method as set forth in claim 1, wherein said step of sintering is defined as heating the magnets including the uniform film under the inert atmosphere of Argon, at the sintering temperature of between 400° C. and 1000° C., and at the sintering pressure of between 10 kPa and 30 kPa for a duration of between 10 hours and 90 hours.

9. The method as set forth in claim 1, wherein said step of machining being further defined as subjecting the sintered magnet block to a cutting, grinding, and polishing the sintered magnet to produce the machined magnet block.

10. The method as set forth in claim 1, wherein said step of cleaning the surfaces of the machined magnets including the steps of:

degreasing the surfaces of the machined magnets; pickling the surfaces of the machined magnets; activating the surfaces of the machined magnets;

rinsing the surfaces of machined magnets using deionized water; and drying the surfaces of machined magnets to produce the cleaned magnets.

* * * * *